US005762513A

United States Patent [19]

Stine

[11] Patent Number: 5,762,513

[45] Date of Patent: Jun. 9, 1998

[54] ELECTRICAL CONNECTOR ASSEMBLY

[75] Inventor: Jon Davidson Stine, Elizabethtown, Pa.

[73] Assignee: The Whitaker Corporation, Wilmington, Del.

[21] Appl. No.: 666,716

[22] Filed: Jun. 18, 1996

[51] Int. Cl.[6] ..... H01R 13/627

[52] U.S. Cl. ..... 439/358; 439/404; 439/435

[58] Field of Search ..... 439/357, 358, 439/404, 405, 417, 435, 456, 459, 470, 701

[56] References Cited

U.S. PATENT DOCUMENTS

| | | | |
|---|---|---|---|
| 4,025,141 | 5/1977 | Thelissen . | |
| 4,380,361 | 4/1983 | Asick et al. . | |
| 4,406,510 | 9/1983 | Debortoli et al. . | |
| 4,433,888 | 2/1984 | Winger . | |
| 4,602,839 | 7/1986 | Winger . | |
| 4,621,885 | 11/1986 | Szczesny et al. . | |
| 4,657,331 | 4/1987 | Coldren . | |
| 4,669,801 | 6/1987 | Worth | 439/404 |
| 4,681,386 | 7/1987 | Boulanger | 439/347 |
| 4,687,276 | 8/1987 | Stockmaster | 439/557 |
| 4,693,533 | 9/1987 | Szczesny et al. | 439/350 |
| 4,708,662 | 11/1987 | Klein | 439/353 |
| 5,021,004 | 6/1991 | Heiney | 439/317 |
| 5,080,604 | 1/1992 | Rider et al. | 439/357 |
| 5,100,342 | 3/1992 | Olsson | 439/497 |
| 5,114,362 | 5/1992 | Olsson | 439/460 |
| 5,125,850 | 6/1992 | Locati | 439/404 |
| 5,409,396 | 4/1995 | Bowen et al. | 439/465 |

*Primary Examiner*—Khiem Nguyen
*Attorney, Agent, or Firm*—Anton P. Ness

[57] ABSTRACT

An electrical connector assembly (1) including a header (2), a housing (3) matable with the header (2), a termination cover (4) retained on the housing (3), and a wiring strain relief (5), with housing (3), cover (4) and strain relief (5) securable as a unit to header (2). Latches (25) include a latch arm (26) on the strain relief (5) extending past the termination cover (4) and engaging and latching to the header (2), and further include overstress stops (30) movable to engage surfaces (31) on the strain relief (5) and resist further pivoting movement of the latch arms (26).

6 Claims, 4 Drawing Sheets

ELECTRICAL CONNECTOR ASSEMBLY

FIELD OF THE INVENTION

The invention relates to an electrical connector assembly comprising, a connector for termination of electrical wiring and a header to which the connector mates.

BACKGROUND OF THE INVENTION

U.S. Pat. No. 5,125,850 discloses an electrical connector having a housing, electrical contacts in the housing, a termination cover and a strain relief. The termination cover is movable toward the housing to terminate wiring to the electrical contacts, and the strain relief is movable toward the termination cover to clamp the wiring between the strain relief and the termination cover, with the strain relief latching to the housing. The housing is constructed to mate with a header, and the housing and the header may unmate without a latch that attaches the housing to the header.

U.S. Pat. No. 4,621,885 discloses an electrical connector assembly having a header and electrical mating contacts in the header, and an electrical connector comprising a housing for mating with the header, electrical contacts for connection to the mating contacts and being constructed for connection to wiring, and clips for attaching the header and the housing. The clips prevent undesired disconnection of the header and the housing.

A problem to be solved is to provide latches that attach to the header, not only a housing, but also a termination cover and a strain relief that are separate parts. Such latches would provide the advantage that all separate parts become latched to the header. A further problem to be solved is to prevent overstress of the latch when flexed.

SUMMARY OF THE INVENTION

According to the invention, an electrical connector assembly of various separate parts are latched to a header by a pivoting latch arm connected by an integral flexing hinge to a wiring strain relief, and an overstress stop on a rear of each latch arm initially spaced from a stop surface on the strain relief, and the stop being movable to engage the stop surface and resist further pivoting movement of the latch arm, thereby limiting internal stress when flexing the hinge.

Such a latch arm is inexpensive because it is integral with the strain relief, and can be manufactured as one piece with the strain relief. Further, overstress of the latch when flexed is prevented by the feature of the stop and stop surface.

DESCRIPTION OF THE DRAWINGS

An embodiment of the invention will now be described by way of reference to the accompanying drawings, according to which.

DETAILED DESCRIPTION

Figure 1:
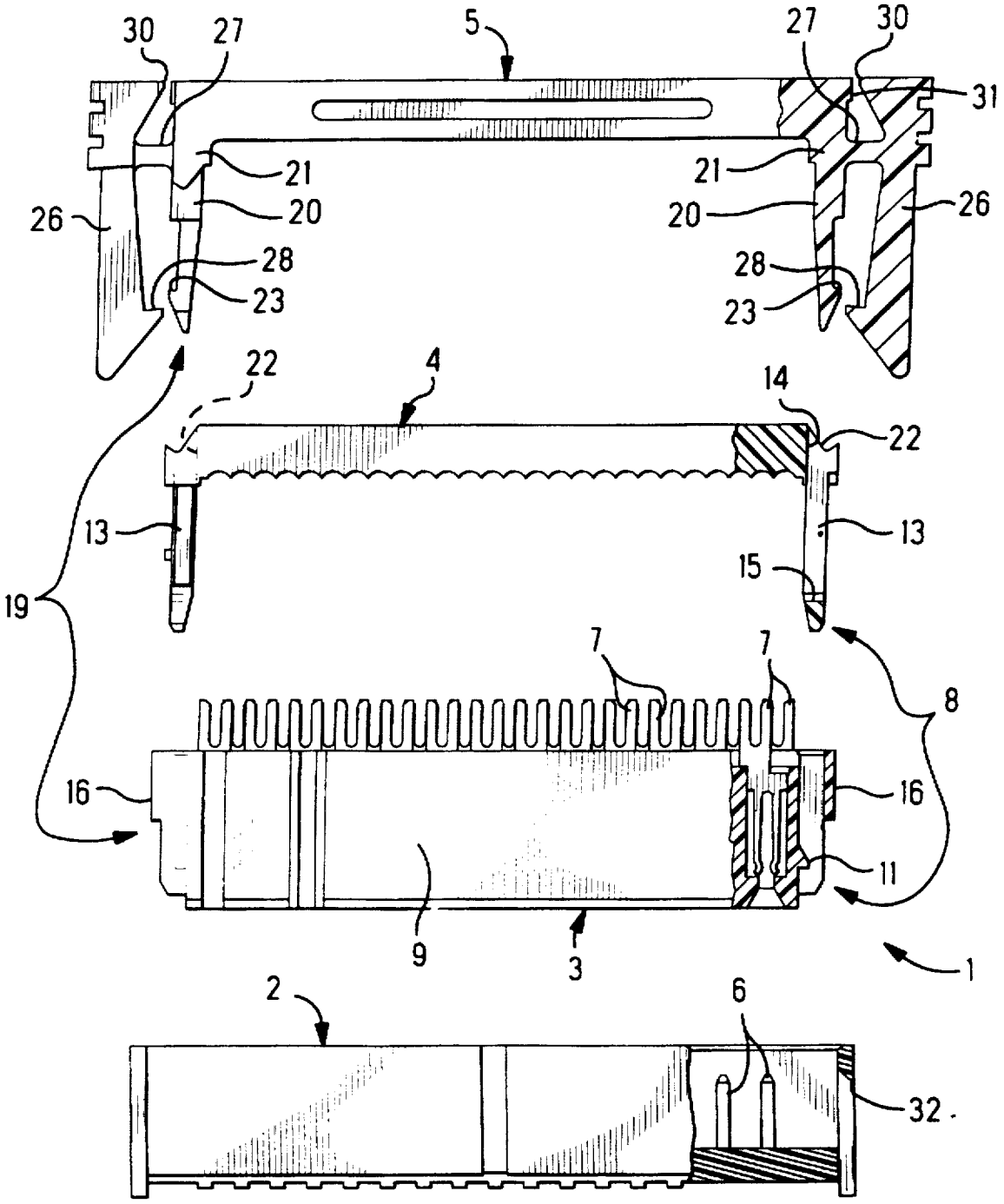
FIG. 1 is a front view of an electrical connector assembly with parts separated from one another, and with parts cut away to illustrate features.
Figure 4:
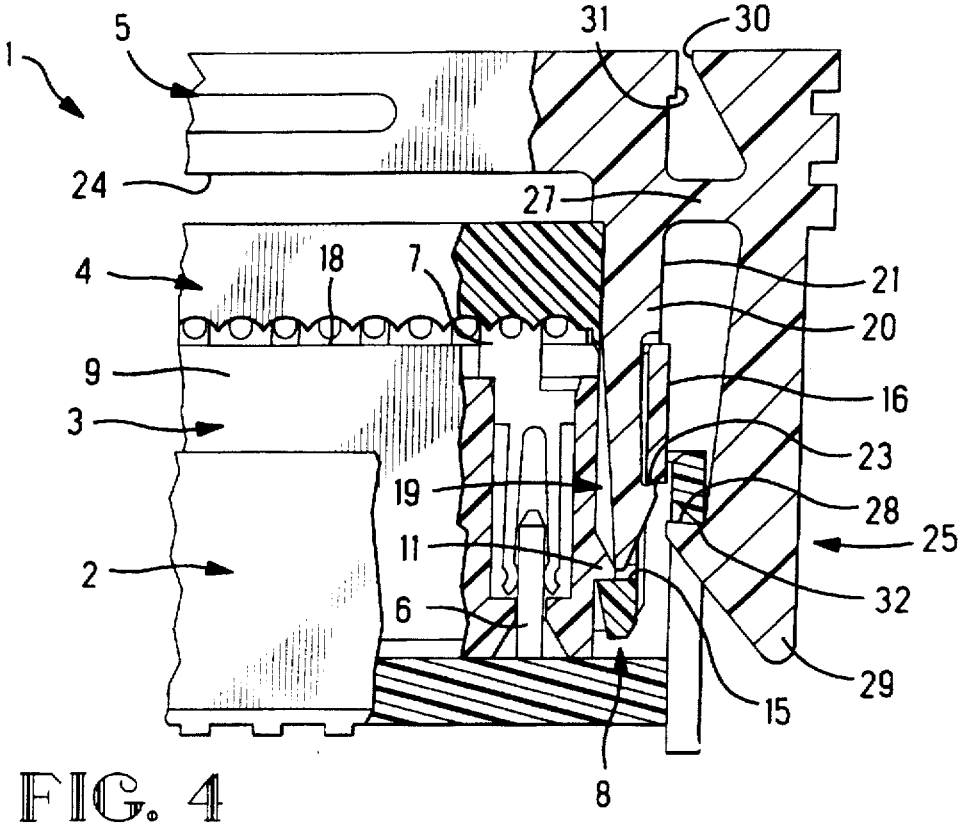
FIG. 4 is a view similar to FIG. 1, illustrating all the parts assembled and latched together.

With reference to FIG. 1, an electrical connector assembly 1 comprises a header 2, a housing 3, a termination cover 4 and a wiring strain relief 5, each of which is of unitary construction by being fabricated by molding an insulating plastic material. Electrical mating contacts 6 in the header 2 are adapted to mate with electrical contacts 7 in the housing 3, when the housing 3 is mated with the header 2, as shown in FIG. 4. Terminals on the contacts 7 extend at a rear 9 of the housing for connection to wiring, not shown. Details of the wiring and the contacts 7 and the mating contacts 6 are disclosed, for example, in U.S. Pat. No. 4,621,885.

Figure 2:
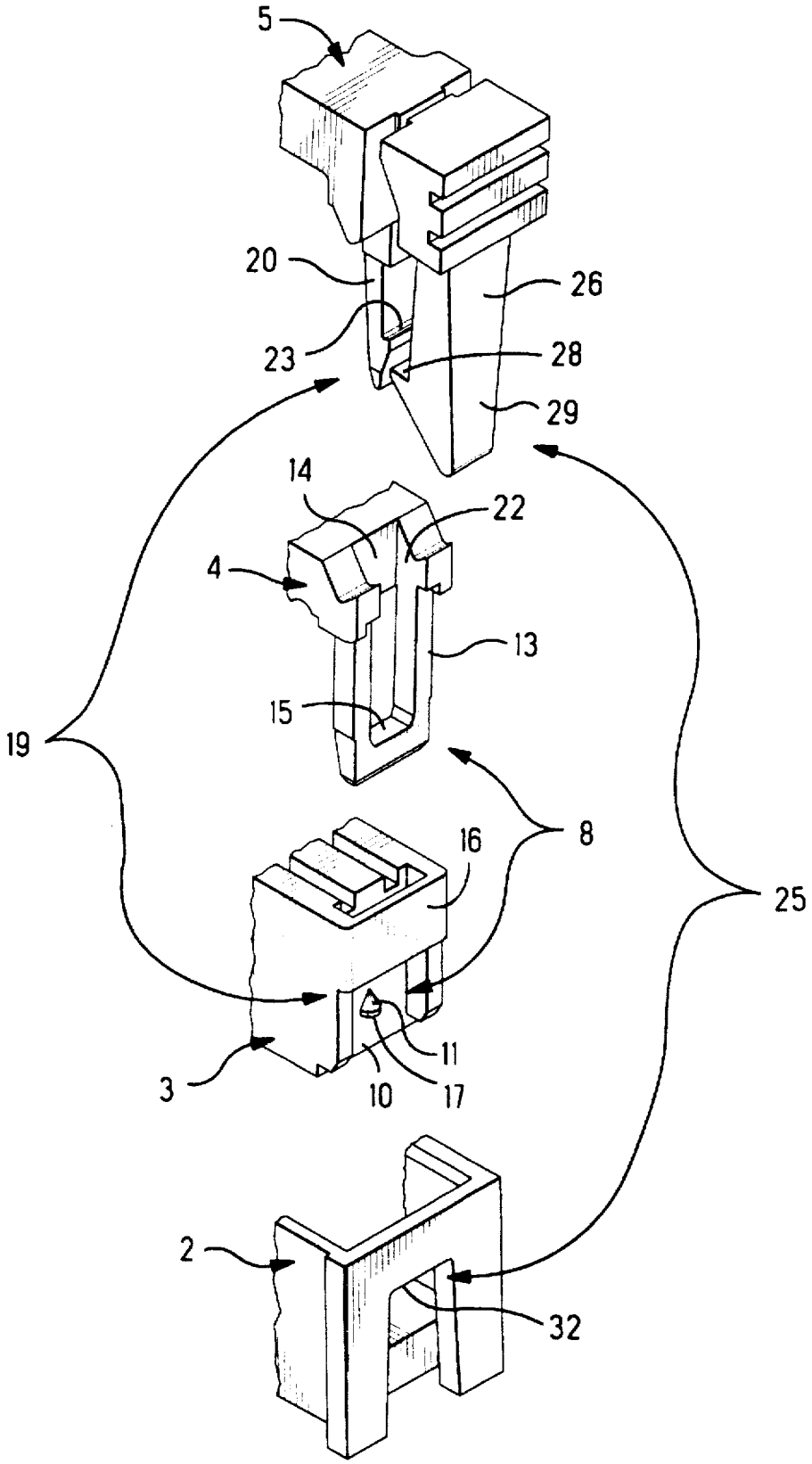
FIG. 2 is a fragmentary isometric view of the latching system of the device shown in FIG. 1, with parts separated from one another.
Figure 3:
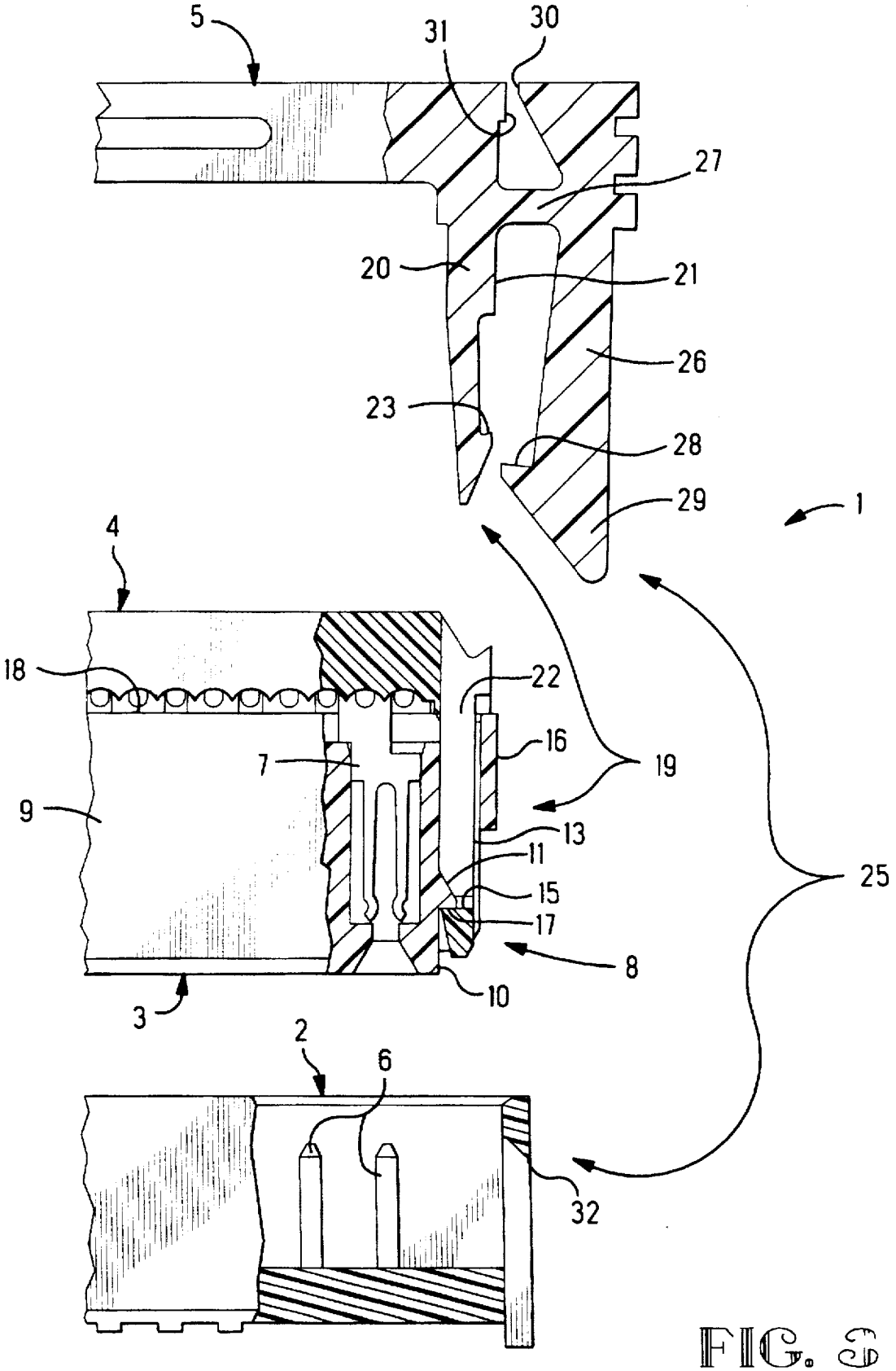
FIG. 3 is a view similar to FIG. 1, illustrating some of the parts assembled and latched together.
Figure 5:
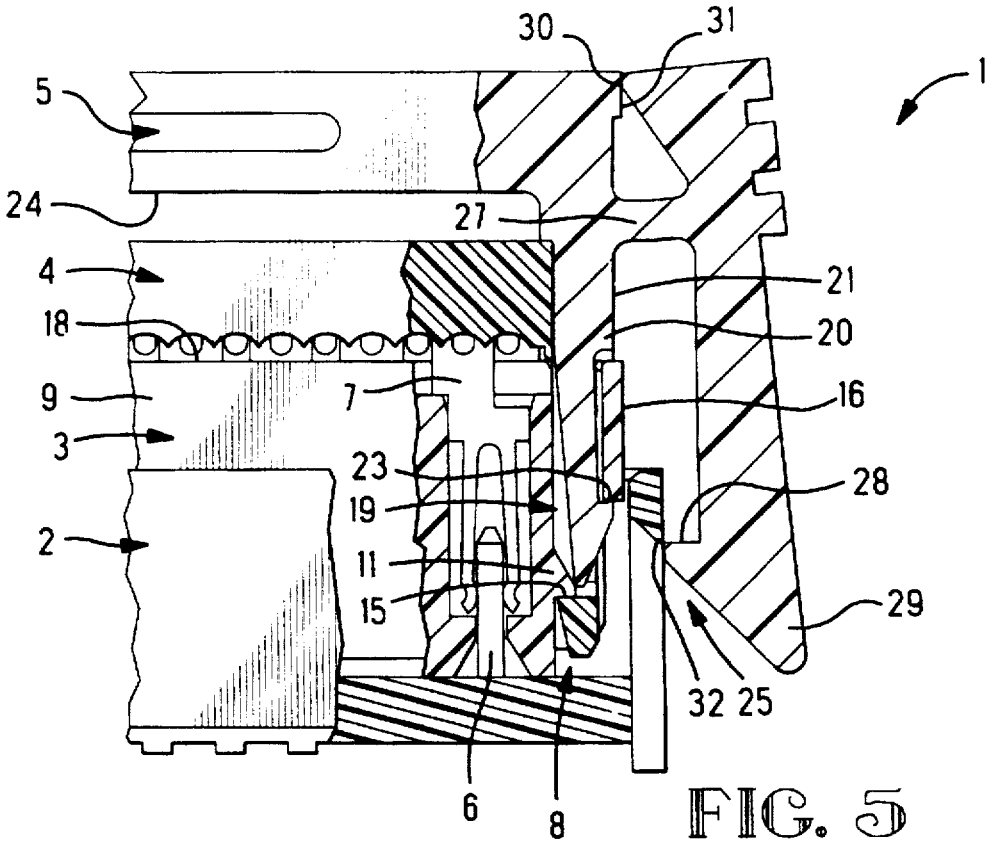
FIG. 5 is a view similar to FIG. 4, illustrating a flexing latch and overstress of the latch being prevented.

With reference to FIGS. 2, 4 and 5, first latches 8 retain the termination cover 4 on the rear 9 of the housing 3. The latches 8 are on both opposite ends 10 of the housing 3. Each of the latches comprises an inclined latching projection 11 integral with a corresponding end 10 of the housing 3, and a latching arm 13 on and integral with a corresponding end 14 on the termination cover 4. The latching arm 13 is in the form of a hasp having a latching surface 15. The latching arm 13 is attached to the remainder of the termination cover 4 as a resiliently deflectable cantilever beam. The latching arm 13 passes through a corresponding yoke 16 integral with the housing 3. After passing through the yoke 16, the latching arm 13 rides over the projection 11 and the latching surface 15 opposes and latches against a latching surface 17 on the projection 11. A wiring receiving passage 18 is between the termination cover 4 and the rear 9 of the housing 3 (FIGS. 3 to 5). The termination cover 4 urges wiring that has been located in the passage 18, to connect with the terminals on the contacts 7 in a manner as disclosed, for example, in U.S. Pat. No. 4,621,885.

Second latches 19 retain the strain relief 5 on the termination cover 4; each of second latches 19 comprises the yoke 16 and a latching finger 20. The latching fingers 20 are on, and are integral with, opposite ends 21 on the wiring strain relief 5. Each of the latching fingers 20 is attached to the remainder of the wiring strain relief 5 as a resiliently deflectable cantilever beam. Each of the latching fingers 20 passes through an open rear end 22 on a first latching arm 13. The latching finger 20 is shorter than the first latching arm 13 and yet extends past a rear of the termination cover 4 to engage the housing 3. A latching surface 23 on the latching finger 19 hooks and latches against a corresponding yoke 16. A second wiring receiving passage 24 is between the strain relief 3 and the termination cover 4. The wiring that would extend through the first passage 18 loops back and extends through the second passage 24, in a manner as disclosed, for example, in U.S. Pat. No. 4,621,885.

Each of third latches 25 comprises: a pivoting latch arm 26 connected by an integral flexing hinge 27 to a remainder of the strain relief 3; a latching surface 28 on a hook portion 29 of the latch arm 26; and a projecting overstress stop 30 on a rear of each latch arm 26. The latch arm 26 extends past the termination cover 4 and the housing 3 to engage the header 2. The stop 30 is initially spaced from a stop surface 31 on the strain relief 3. When the assembly of housing 3, termination cover 4 and wiring strain relief 5 are being affixed as a unit to header 2, the latching surface 28 on the latch arm 26 hooks onto an undercut latching surface 32 on the header 2. Pivoting latch arms 26 are exposed for manual engagement at their rearward end to be pivoted as levers for delatching from header 2, with the hinge 27 as a fulcrum, causing the hinge 27 to flex resiliently moving hook portions 29 outwardly.

With reference to FIG. 5, the stop 30 is movable to engage the surface 31 and thus resist further pivoting movement of the corresponding latch arm 26, thereby limiting the amount of flexure in the hinge 27, as well as limiting the internal stress in the hinge 27 when flexing the hinge 27. For example, the latch arm 26 is pivoted to a position which disengages the latching surface 28 from the undercut latching surface 32 on the header 2. This allows unmating of the housing 3 from the header 2 and removal from the header 2 as a unit, the housing 3, the termination cover 4, the strain relief 5 and wiring (not shown).

A feature of the invention resides in a system of latches that attach to a header, not only a housing, but also a termination cover and a strain relief that are separate parts. Such latches provide the advantage that all separate parts become latched to the header. A further advantage resides in the provision of overstress stops on integral latches that prevent overstress of the integral latches when flexed.

What is claimed is:

1. An electrical connector assembly, comprising:

a header defining a housing-receiving shroud, a housing being matable with the header, a termination cover retained on the rear of the housing by first latch arms at ends of the termination cover and received into recesses at opposed ends of the housing, a first wiring receiving passage between the termination cover and the housing, with said first latch arms including passages extending forwardly therealong from rear ends thereof, and a wiring strain relief having second latch arms proximate ends thereof to extend into the passages of the first latch arms and into recesses of the housing at ends thereof, with latching projections extending facing outwardly to latch past a forward facing ledge along the respective housing end to retain the strain relief on the housing, a second wiring receiving passage between the strain relief and the termination cover, the header receiving into the shroud thereof the housing and the termination cover, with the leading end of the shroud extending past and outwardly of the second latch arms of the strain relief, and third latch arms at the ends of the strain relief outwardly of the second latch arms and extending along the ends of the header and latchably engaging the header, the third latch arms being adapted for manipulation to delatch from the header.

2. The assembly as set forth in claim 1 wherein flexible hinges join the third latch arms to bases of the second latch arms.

3. The assembly as set forth in claim 1 wherein overstress stops are defined on the latch arms of respective third latches initially spaced from respective stop surfaces on a body of the strain relief, and the stops being movable to engage the surfaces and resist further pivoting movement of the latch arms.

4. An electrical connector assembly, comprising:

a header defining a housing-receiving shroud, and electrical mating contacts in the shroud, a housing being matable with the header, electrical contacts in the housing, the electrical contacts being matable with the mating contacts, terminals on the contacts extending at a rear of the housing for connection to wiring, a termination cover, first latch arms at ends of the termination cover and received into recesses at opposed ends of the housing to retain the termination cover on the rear of the housing, a first wiring receiving passage between the termination cover and the housing, with said first latch arms including passages extending forwardly therealong from rear ends thereof, a wiring strain relief having second latch arms proximate ends thereof to extend into the passages of the first latch arms and into recesses of the housing at ends thereof, with latching projections extending facing outwardly to latch past a forward facing ledge along the respective housing end, and a second wiring receiving passage between the strain relief and the termination cover, the header receiving into the shroud thereof the housing and the termination cover, with the leading end of the shroud extending past and outwardly of the second latch arms of the strain relief, and third latch arms at the ends of the strain relief outwardly of the second latch arms and extending along the ends of the header for latching the strain relief to the header, the third latch arms each being pivotable and connected by an integral flexible hinge to respective ends of a body of the strain relief.

5. The assembly as set forth in claim 4 wherein the flexible hinges join the third latch arms to bases of the second latch arms.

6. The assembly as set forth in claim 4 wherein overstress stops are defined on the latch arms of respective third latches initially spaced from respective stop surfaces on a body of the strain relief, and the stops are movable during pivoting of the third latch arms to engage the surfaces and resist further pivoting movement of the third latch arms.

* * * * *